US011359492B2

(12) United States Patent
Kim et al.

(10) Patent No.: US 11,359,492 B2
(45) Date of Patent: Jun. 14, 2022

(54) METHOD AND APPARATUS FOR PREVENTING ACCIDENT IN TUNNEL

(71) Applicant: NATIONAL DISASTER MANAGEMENT RESEARCH INSTITUTE, Ulsan (KR)

(72) Inventors: Seong Sam Kim, Ulsan (KR); Hyun Ju Nho, Ulsan (KR); Je Sung Park, Ulsan (KR); Hyun Ju Kim, Ulsan (KR)

(73) Assignee: NATIONAL DISASTER MANAGEMENT RESEARCH INSTITUTE, Ulsan (KR)

( * ) Notice: Subject to any disclaimer, the term of this patent is extended or adjusted under 35 U.S.C. 154(b) by 0 days.

(21) Appl. No.: 17/102,845

(22) Filed: Nov. 24, 2020

(65) Prior Publication Data

US 2021/0164348 A1 Jun. 3, 2021

(30) Foreign Application Priority Data

Dec. 2, 2019 (KR) ..... 10-2019-0158021

(51) Int. Cl.

| | |
|---|---|
| ***E21F 11/00*** | (2006.01) |
| ***E21F 17/18*** | (2006.01) |
| ***G08B 21/08*** | (2006.01) |
| ***G08B 21/10*** | (2006.01) |
| ***G08B 25/01*** | (2006.01) |

(52) U.S. Cl.

CPC ..... *E21F 11/00* (2013.01); *E21F 17/18* (2013.01); *G08B 21/084* (2013.01); *G08B 21/10* (2013.01); *G08B 25/016* (2013.01)

(58) Field of Classification Search

CPC ..... E21F 11/00; E21F 17/18; G08B 21/084; G08B 7/066

See application file for complete search history.

(56) References Cited

U.S. PATENT DOCUMENTS

| | | | | |
|---|---|---|---|---|
| 7,673,629 | B2 * | 3/2010 | Turiello | E21F 11/00 128/204.21 |
| 9,675,771 | B2 * | 6/2017 | Jafari | A61M 16/0051 |
| 10,207,069 | B2 * | 2/2019 | Jafari | A61M 16/024 |

(Continued)

FOREIGN PATENT DOCUMENTS

| | | | |
|---|---|---|---|
| CN | 104179514 | A | 12/2014 |
| CN | 107059759 | A | 8/2017 |

(Continued)

*Primary Examiner* — Mirza F Alam

(74) *Attorney, Agent, or Firm* — Maier & Maier, PLLC

(57) ABSTRACT

Provided is a control method for preventing an accident in a tunnel. In this instance, the control method for preventing an accident in a tunnel includes estimating water amount information flowing into the tunnel based on at least one input information, determining whether it is an emergency situation based on the estimated water amount information, and when the emergency situation is determined, transmitting a warning message to an identification device, and controlling a device for opening and closing an entrance/exit of the tunnel. In this instance, the water amount information flowing into the tunnel is estimated through a deep learning based learning model, and the emergency situation is determined by comparing water level information of the tunnel with a threshold value.

6 Claims, 8 Drawing Sheets

(56) References Cited

U.S. PATENT DOCUMENTS

| | | | | |
|---|---|---|---|---|
| 2008/0122634 | A1* | 5/2008 | Mardirossian | E21F 17/18<br>340/573.1 |
| 2008/0137589 | A1* | 6/2008 | Barrett | H04W 4/33<br>370/327 |

FOREIGN PATENT DOCUMENTS

| | | | |
|---|---|---|---|
| KR | 10-1671209 | B1 | 11/2016 |
| KR | 10-2017-0089154 | A | 8/2017 |

* cited by examiner

METHOD AND APPARATUS FOR PREVENTING ACCIDENT IN TUNNEL

CROSS-REFERENCE TO RELATED APPLICATION

This application claims priority to Korean Patent Application No. 10-2019-0158021, filed on Dec. 2, 2019, and all the benefits accruing therefrom under 35 U.S.C. § 119, the contents of which in its entirety are herein incorporated by reference.

FIELD

The present disclosure relates to a method and apparatus for preventing an accident in a tunnel. More particularly, the present disclosure relates to a method and apparatus for preventing losses of lives by detecting the cause of an accident that may occur in a tunnel.

BACKGROUND

A tunnel is generally deep and dark, so it may not be easy to check if there are workers in the tunnel under construction. Additionally, tunnel construction is usually carried out in the underground, and thus there is a high risk of losses of lives when the amount of water increases in the event of rainfall.

In many cases, a tunnel construction manager manages the workers. Additionally, since devices for wireless communication do not work properly in the tunnel, to notify a critical or emergency situation to the workers in the tunnel, people must go into the tunnel and inform the situation, and accordingly it is difficult to cope with the emergency situation that changes in real time.

In view of the foregoing, there is required a method for detecting the cause of an accident quickly in real time during tunnel construction and transmitting the detected information to the worker quickly, and it will be described below.

SUMMARY

The present disclosure is directed to providing a method and apparatus for preventing an accident in a tunnel.

The present disclosure is further directed to providing a method and apparatus for preventing losses of lives by detecting the cause of an accident that may occur in a tunnel.

The present disclosure is further directed to providing a method and apparatus for transmitting an emergency situation quickly by attaching a wireless communication device to a tunnel worker's device.

According to an embodiment of the present disclosure, there is provided a control method for preventing an accident in a tunnel. In this instance, the control method for preventing an accident in a tunnel includes estimating water amount information flowing into the tunnel based on at least one input information, determining whether it is an emergency situation based on the estimated water amount information, and when the emergency situation is determined, transmitting a warning message to an identification device and controlling a device for opening and closing an entrance/exit of the tunnel. In this instance, the water amount information flowing into the tunnel may be estimated through a deep learning based learning model, and the emergency situation may be determined by comparing water level information of the tunnel with a threshold value.

Additionally, according to an embodiment of the present disclosure, there is provided a server for preventing an accident in a tunnel. In this instance, the server includes a location identifying unit to identify a location in the tunnel, a water amount measuring unit to measure an amount of water in the tunnel based on the identified location, a deep learning unit to perform water amount estimation based on the measured water amount information, a transmitting/receiving unit to communicate with an external device, and a control unit to control the location identifying unit, the water amount measuring unit, the deep learning unit and the transmitting/receiving unit. In this instance, the control unit may estimate water amount information flowing into the tunnel based on at least one input information, determine whether it is an emergency situation based on the estimated water amount information, and transmit a warning message to an identification device and control a device for opening and closing an entrance/exit of the tunnel when the emergency situation is determined, and the water amount information flowing into the tunnel may be estimated through a deep learning based learning model, and the emergency situation may be determined by comparing water level information of the tunnel with a threshold value.

Additionally, according to an embodiment of the present disclosure, there is provided an identification device for preventing an accident in a tunnel. In this instance, the identification device may include a transmitting/receiving unit to communicate with an external device and a control unit to control the transmitting/receiving unit. In this instance, the control unit may receive a warning message from an safety helmet built-in device and output warning information based on the received warning message, and when an emergency situation is determined, the warning message may be received from the safety helmet built-in device, the emergency situation may be determined based on estimated water amount information of the tunnel, and the water amount information of the tunnel may be estimated through a deep learning based learning model.

Additionally, the method, the server, the identification device and the safety helmet built-in device for preventing an accident in a tunnel may have the following common features.

Additionally, according to an embodiment of the present disclosure, the input information may include at least one of rainfall amount information, location information in the tunnel, water movement duration information, surrounding environmental information, nearby river water amount information or floodgate opening/closing information.

Additionally, according to an embodiment of the present disclosure, the water amount information at a first location in the tunnel may be measured at a first point in time based on at least one of the input information, and the deep learning based learning model may be updated based on the measured water amount information and the at least one input information.

Additionally, according to an embodiment of the present disclosure, the identification device may be a device mounted on a safety helmet, location information of the identification device may be identified based on at least one safety helmet built-in device installed in the tunnel, and when the emergency situation is determined, the warning message may be transmitted from the safety helmet built-in device based on the identified location information of the identification device.

Additionally, according to an embodiment of the present disclosure, a device for opening and closing at least one door in the tunnel may be further controlled based on the emergency situation, and when the emergency situation is determined, the entrance/exit of the tunnel may be controlled to be closed, and opening or closing of the at least one door may be determined based on the location of the identification device.

Additionally, according to an embodiment of the present disclosure, there is provided a control method for preventing an accident in a tunnel. In this instance, the control method for preventing an accident in a tunnel comprising:

estimating water amount information flowing into the tunnel based on at least one input information; determining whether it is an emergency situation based on the estimated water amount information; and when the emergency situation is determined, transmitting a warning message to an identification device, and controlling a device for opening and closing an entrance/exit of the tunnel, wherein the water amount information flowing into the tunnel is estimated through a deep learning based learning model, the emergency situation is determined by comparing water level information of the tunnel with a threshold value, determining whether it is the emergency situation comprises dividing an inside of the tunnel into a predetermined interval, and determining whether it is the emergency situation taking into account a width and a height of the tunnel, a reference water level and floating matter for each predetermined interval, the identification device is a device mounted on a safety helmet of a worker in the tunnel, and location information of the identification device is identified based on at least one safety helmet built-in device installed in the tunnel, and controlling the device for opening and closing the entrance/exit of the tunnel comprises opening or closing a door at a region in which a water level is high or a danger is predicted to control the amount of water at a location of the worker and an escape route taking into account the location of the worker in the tunnel in case of the emergency situation.

The present disclosure may provide a method and apparatus for preventing an accident in a tunnel.

The present disclosure may provide a method and apparatus for preventing losses of lives by detecting the cause of an accident that may occur in a tunnel.

The present disclosure may provide a method and apparatus for transmitting an emergency situation quickly using a wireless communication device attached to a tunnel worker's device.

The effects that can be obtained from the present disclosure are not limited to the above-mentioned effects, and other effects not mentioned herein will be clearly understood by those skilled in the art from the following description.

DETAILED DESCRIPTION OF THE EMBODIMENTS

Hereinafter, the preferred embodiments of the present disclosure will be described in detail with reference to the accompanying drawings. The detailed description disclosed below along with the accompanying drawings is made to describe exemplary embodiments of the present disclosure, but not intended to represent only one embodiment in which the present disclosure is carried out. The following detailed description includes the detailed subject matter to provide a full and complete understanding of the present disclosure. However, those skilled in the art understand that the present disclosure may be carried out without such detailed subject matter.

The following embodiments are a predetermined combination of elements and features of the present disclosure. Unless otherwise expressly stated herein, each element or feature may be considered as optional. Each element or feature may operate in non-combination with other elements or features. Additionally, the embodiments of the present disclosure may comprise a combination of some elements and/or features. The order of the operations described in the embodiments of the present disclosure may change. Some elements or features of an embodiment may be included in other embodiments, or replaced with the equivalent elements or features of other embodiments.

The particular terms as used herein are provided to help understanding of the present disclosure, and the use of these particular terms may be modified into different forms without departing from the technical spirit of the present disclosure.

In some cases, to avoid ambiguity in the concept of the present disclosure, known structures and devices are omitted herein, or they are shown in the form of a block diagram based on the essential functions of each structure and device. Additionally, the same element is described using the same reference sign throughout the specification.

Additionally, the terms such as first and/or second may be used to describe various elements, but they should not be limited by the elements. These terms are used to distinguish an element from another, and for example, a first element may be referred to as a second element, and likewise, a second element may be referred to as a first element without departing from the scope of protection based on the concept of the present disclosure.

Additionally, the term "comprising" when used in this specification, specifies the presence of stated elements, but does not preclude the presence or addition of one or more other elements unless stated to the contrary. Additionally, the term "unit" as used herein indicates a processing unit of at least one function or operation, and this may be implemented by a combination of hardware and/or software.

Figure 1:
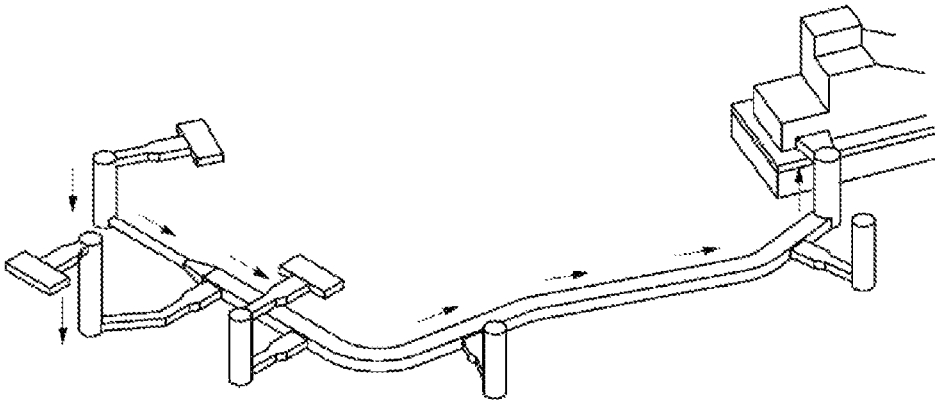
FIG. 1 is a diagram showing a tunnel structure according to an embodiment of the present disclosure.

FIG. 1 is a diagram showing a tunnel structure according to an embodiment of the present disclosure. In an example, the tunnel may come in various types. In an example, the tunnel may be connected to the waterway, and rainwater may flow into the tunnel. Additionally, in an example, the tunnel may be formed in the underground that is lower than the Earth's surface. Additionally, in an example, the tunnel may be formed as underground water supply and drainage facility or waterway. The tunnel may be formed in other types, and the present disclosure does not limit the type of the tunnel.

In a more specific example, referring to FIG. 1, the tunnel 110 may be connected to the waterway and rainwater may flow into the tunnel 110. In this instance, the amount of water in the tunnel 110 may increase by the inflow of rainwater to the tunnel 110. In this instance, when the amount of water in the tunnel 110 increases, the water level in the tunnel 110 may increase. In an example, as described above, when worker(s) is in the tunnel 110 for tunnel construction or management of the tunnel 110, an accident may occur by a sharp increase in the amount of water.

Figure 2:
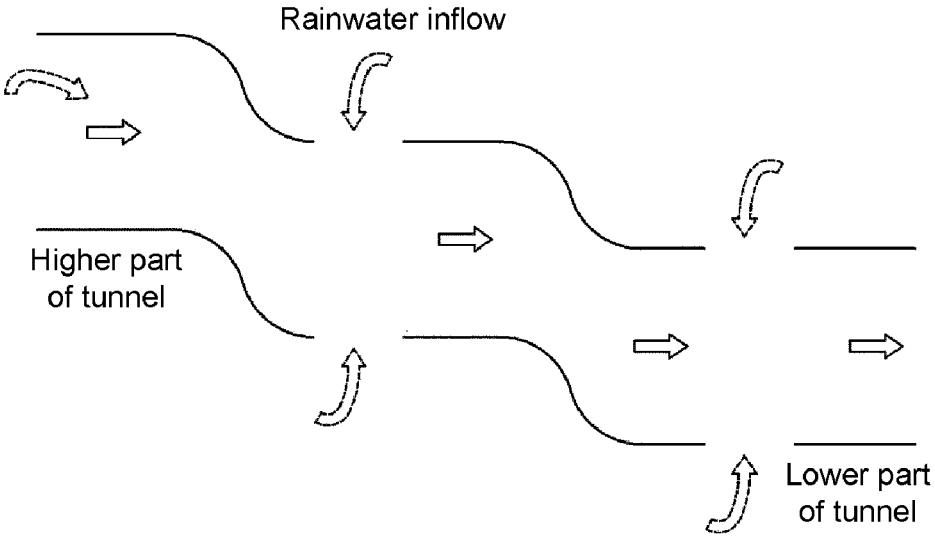
FIG. 2 is a diagram showing the inflow of rainwater to a tunnel according to an embodiment of the present disclosure.

FIG. 2 is a diagram showing the inflow of rainwater to the tunnel according to an embodiment of the present disclosure.

Referring to FIG. 2, the tunnel may be divided into the higher part and the lower part. Additionally, the tunnel may include various passages through which water flows in. In this instance, for treatment, water flowing in through the passages of the tunnel may be treated while moving from the higher part of the tunnel to the lower part of the tunnel. Additionally, in an example, the tunnel may have a watergate, and the amount of water flowing into the tunnel may be used to determine whether to open or close the watergate. In this instance, in an example, when a large amount of rains falls near the tunnel or a large amount of water suddenly flows into the tunnel, the amount of water in the tunnel may increase. In particular, when a large amount of water flows into the lower part of the tunnel connected to the plurality of higher parts of the tunnel all at once, the water level in the tunnel may sharply increase. In an example, as described above, a worker who works for construction in the tunnel or a manager who manages in the tunnel may not cope with the sharp increase in the amount of water in the tunnel. In view of the foregoing, a method and apparatus for managing the amount of water in the tunnel may be necessary.

Figure 3:
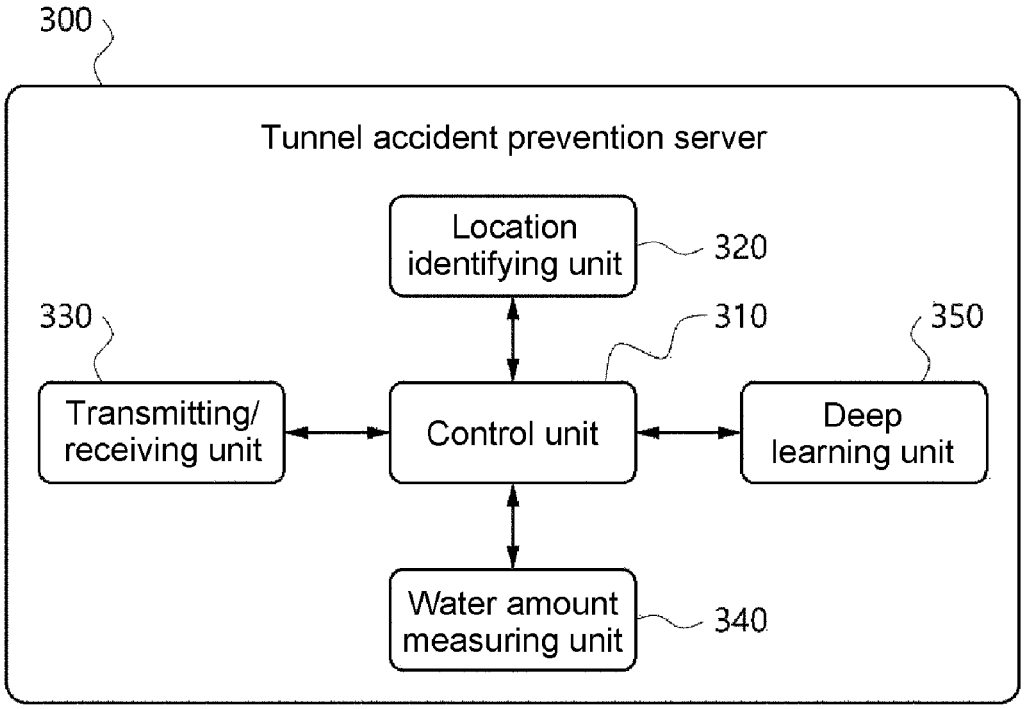
FIG. 3 is a diagram showing a tunnel accident prevention server according to an embodiment of the present disclosure.

FIG. 3 is a diagram showing a tunnel accident prevention server according to an embodiment of the present disclosure.

In an example, referring to FIG. 3, the server 300 (or system) for preventing an accident in a tunnel may be built. In an example, the tunnel accident prevention server 300 may include at least one of a control unit 310, a location identifying unit 320, a transmitting/receiving unit 330, a water amount measuring unit 340 or a deep learning unit 350. In more detail, the tunnel accident prevention server 300 may include the water amount measuring unit 340 to measure the amount of water in the tunnel. In this instance, the control unit 310 of the server 300 may measure the amount of water in the tunnel through the water amount measuring unit 340. In a more specific example, the control unit 310 of the server 300 may measure the current amount of water by measuring the height of the water surface in the tunnel through the water amount measuring unit 340. However, since the amount of water may be not equal at all locations in the tunnel, the tunnel accident prevention server 300 may include the location identifying unit 320. In an example, the control unit 310 of the server 300 may identify each location in the tunnel through the location identifying unit 320. In this instance, the control unit 310 of the tunnel accident prevention server 300 may identify the location of the tunnel through the location identifying unit 320, and measure the amount of water at the corresponding location through the water amount measuring unit 340. In an example, the location identifying unit 320 may include a positioning device installed in the tunnel or any other wireless communication device. Additionally, in an example, the location identifying unit 320 may identify the corresponding location based on an identification device. In an example, the identification device may be Radio Frequency Identification (RFID). Additionally, in an example, the identification device may be a low-energy device. In more detail, since it may be difficult to replace the devices installed in the tunnel, location information may be only transmitted through the device that performs low-energy wireless communication. In an example, the low-energy device may be a beacon device. Additionally, in an example, the low-energy device may be a device that works via Bluetooth, Zigbee or LoRa network, and is not limited to the above-described embodiment. That is, the location identifying unit 320 may be configured to measure the location in the tunnel, and is not limited to the above-described embodiment. Additionally, in an example, the tunnel accident prevention server 300 may include the transmitting/receiving unit 330. In this instance, in an example, the control unit 310 of the tunnel accident prevention server 300 may communicate with other device through the transmitting/receiving unit 330. In an example, the tunnel accident prevention server 300 may transmit the information acquired through the location identifying unit 320 and the water amount measuring unit 340 to other device, and is not limited to the above-described embodiment.

Additionally, in an example, the tunnel accident prevention server 300 may include the deep learning unit 350. In an example, the tunnel accident prevention server 300 may periodically measure the amount of water at the corresponding location in the tunnel, and estimate the amount of water using the measured amount of water as input information. In this instance, information outputted based on the deep learning unit 350 may be the height of the water surface, and it is possible to determine whether the water level is higher than a preset value (a threshold value) by learning the height of the water surface, and it will be described below.

Figure 4:
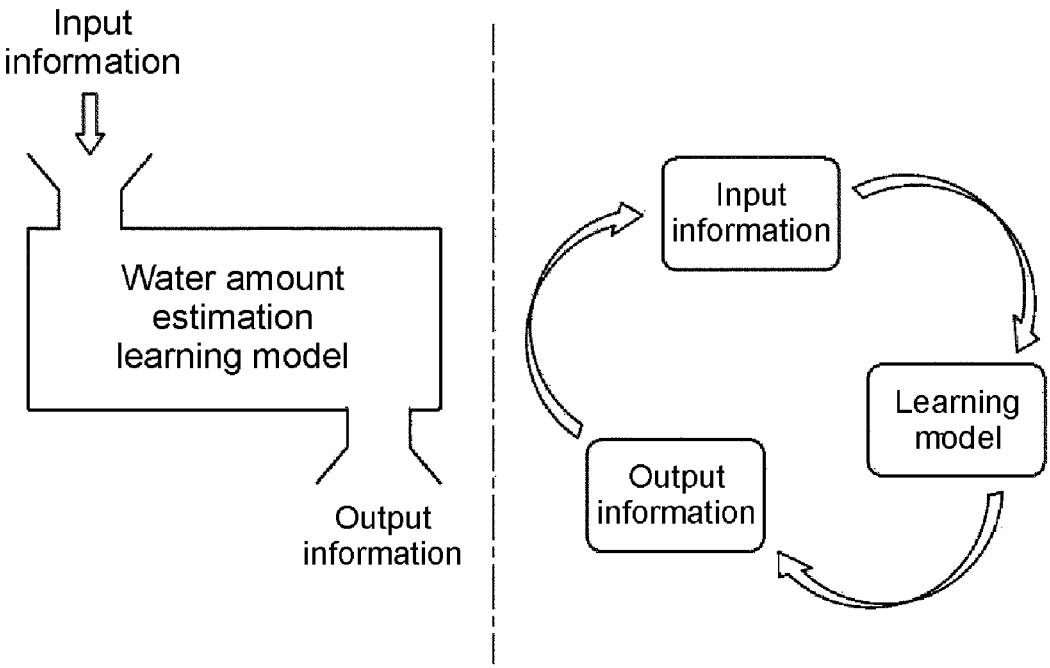
FIG. 4 is a diagram showing a method for setting a learning model for determining the amount of water based on deep learning according to an embodiment of the present disclosure.
Figure 5:
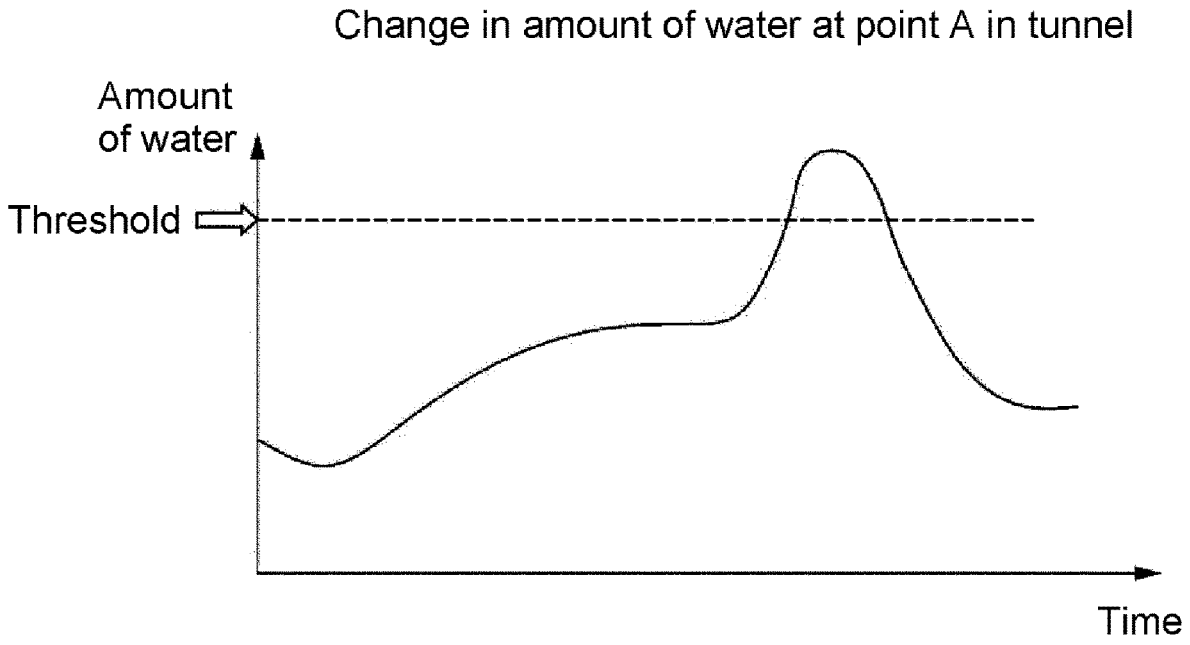
FIG. 5 is a diagram showing a method for determining an emergency situation based on the amount of water according to an embodiment of the present disclosure.

FIGS. 4 and 5 are diagrams showing a method for setting a learning model for determining the amount of water based on deep learning according to an embodiment of the present disclosure.

As described above, the water level at the corresponding location in the tunnel may be measured based on the deep learning unit. In this instance, in an example, when the water level in the tunnel is measured, the tunnel accident prevention server may consider various input information. In an example, the input information may include at least one of rainfall amount information, location information in the tunnel, water movement duration information, surrounding environmental information, nearby river water amount information, floodgate opening/closing information or information that affects the amount of water in the tunnel. In more detail, referring to FIG. 4, the water amount estimation learning model may be set based on the deep learning unit. In this instance, in an example, the water amount estimation learning model may acquire water surface height information as output information based on the above-described various input information. In this instance, as shown in FIG. 5, the water amount estimation learning model may set the threshold for the water level, and acquire information associated with the time at which the water level is higher than the threshold. In a more specific example, the water level may be measured based on the water amount estimation learning model at a specific point A in the tunnel. In this instance, the specific point A may be one of locations at the lower part of the tunnel. In this instance, a change in the height of the water surface at the point A may be continuously measured. In this instance, in an example, the water amount estimation learning model may acquire rainfall information near the tunnel including the higher and lower parts of the tunnel as the input information. Additionally, in an example, the amount of water in the stream or river near the point A or the tunnel may be acquired as the input information. Additionally, the water amount estimation learning model may measure the amount of water at the point B of the higher part of the tunnel, and acquire time information associated with the time when water flows in. Additionally, in an example, the water amount estimation learning model may acquire various information associated with a change in water level at the specific point A, and is not limited to the above-described embodiment. In this instance, the time at which the water level at the specific point A is higher than the threshold value may be identified based on the water amount estimation learning model. In this instance, the tunnel accident prevention server may identify the above-described input information based on the time at which the water level is higher than the threshold value. Subsequently, the tunnel accident prevention server may store the corresponding information as learning information. That is, the tunnel accident prevention server may calculate the time at which the water level is higher than the threshold value based on similar input information, and through this, may transmit a warning message to the worker. Meanwhile, in an example, since a variety of variables may be used as the input information, the water amount estimation learning model may be continuously updated. In an example, the water amount estimation learning model may store water level related information outputted based on the input information as the learning information. Subsequently, the water amount estimation learning model may acquire water level related information outputted based on other input information, and compare it with the existing learning information. In this instance, the water amount estimation learning model may calculate a difference of the output information, and update the learning information by reflecting the difference. In an example, the tunnel may continuously acquire output information to the input information, and continuously update the learning information based on the accumulated output information. Through the foregoing, the learning model may estimate water level information through the accumulated data, and through this, may transmit estimation information for preventing an accident to the worker.

Figure 6:
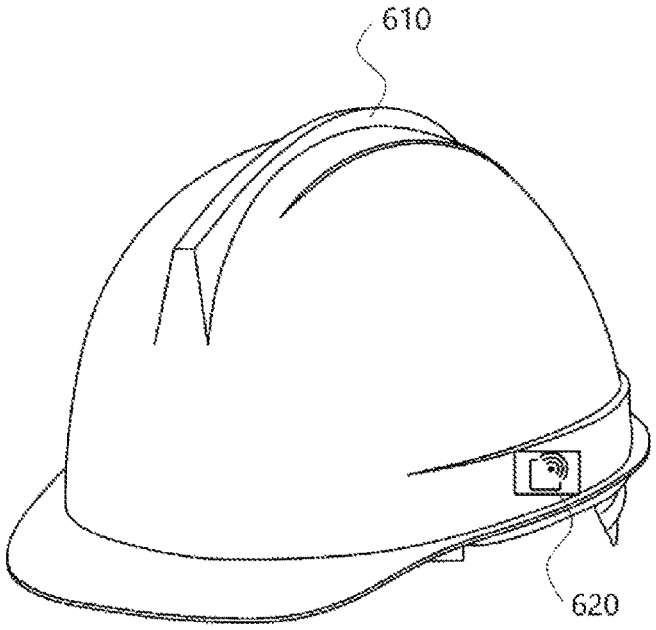
FIG. 6 is a diagram showing a method for identifying a worker through a safety helmet according to an embodiment of the present disclosure.

FIG. 6 is a diagram showing a method for identifying a worker through a safety helmet according to an embodiment of the present disclosure.

As described above, information associated with an accident may be acquired at each point of the tunnel through the tunnel accident prevention server. In this instance, in an example, although the above description is made based on the amount of water in the tunnel, an accident in the tunnel may occur by various causes. In an example, an accident may be predicted by updating the learning information based on input information related with rockfall or crack information. Additionally, an accident in the tunnel may be predicted by updating a variety of other related information based on the learning model, and is not limited to the above-described embodiment.

In this instance, in an example, referring to FIG. 6, an identification device 620 may be attached to the safety helmet 610 of the worker. In this instance, in an example, the identification device 620 may be RFID. Additionally, in an example, the identification device may be various types, and is not limited to the above-described embodiment. In this instance, in an example, the identification device 620 attached to the safety helmet 610 may be identification information based on user information wearing the corresponding safety helmet 610. In a specific example, the unique identification information may be allocated to the identification device 620 of each safety helmet 610. That is, a worker of the safety helmet 610 may be preset, and the identification information of the identification device 620 may be determined based on the worker of the safety helmet 610. In another example, the identification information may be allocated in real time. In an example, when the safety helmet 610 is determined to be used, the identification device 620 of the safety helmet 610 may be recognized. In this instance, the identification information may be recorded on the recognized identification device 620, and the identification information may be managed to match the user of the corresponding safety helmet 610. That is, the user may be allocated with the identification information in real time, the worker wearing the safety helmet 610 having the allocated identification information may perform a task, and the task location may be identified in real time.

Although FIG. 6 is described based on the safety helmet 610 in an example, the identification device 620 may be attached to various types of devices. In an example, the identification device 620 may be attached to the worker's clothing or shoe. Additionally, in an example, the identification device 620 may be possessed by the worker as a separate device. That is, the identification device 620 may come in various types, and is not limited to the above-described embodiment.

Figure 7A:
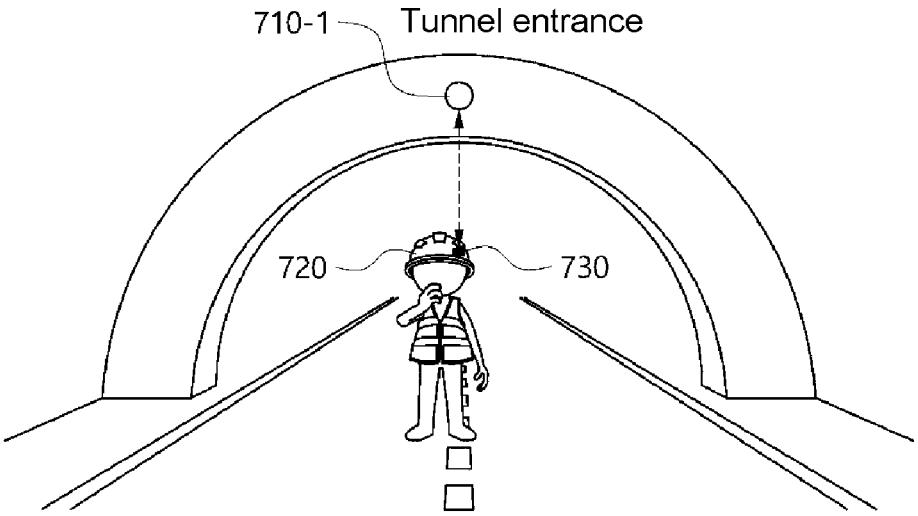
FIG. 7A is a diagram showing a method for identifying a worker in a tunnel according to an embodiment of the present disclosure.

FIG. 7 is a diagram showing a method for identifying the worker in the tunnel according to an embodiment of the present disclosure.

Based on the foregoing, the worker wearing the safety helmet may be allocated with the identification information. In this instance, in an example, referring to FIG. 7A, the worker wearing the safety helmet 720 may pass through the entrance of the tunnel. In this instance, an safety helmet built-in device 710-1 may be provided at the entrance of the tunnel to recognize an identification device 730 mounted on the safety helmet 720. In this instance, in an example, the safety helmet built-in device 710-1 may be a device installed at the entrance of the tunnel. In an example, the safety helmet built-in device 710-1 may be the above-described low-energy device, and may be a device for recognizing the identification device 730 of the safety helmet 720. In another example, the helmet built-in device 710-1 at the entrance of the tunnel may be easy to install and replace, and thus may be built in the form of a server, not a low-energy device, and is not limited to the above-described embodiment. In this instance, when the worker wearing the safety helmet 720 passes through the entrance of the tunnel, the helmet built-in device 710-1 may identify the identification device 730 of the safety helmet 720, and acquire identification information. In this instance, in an example, the identification information may be unique information of the worker as described above. That is, it is possible to identify if the worker passed through the entrance of the tunnel based on the identification information.

Figure 7B:
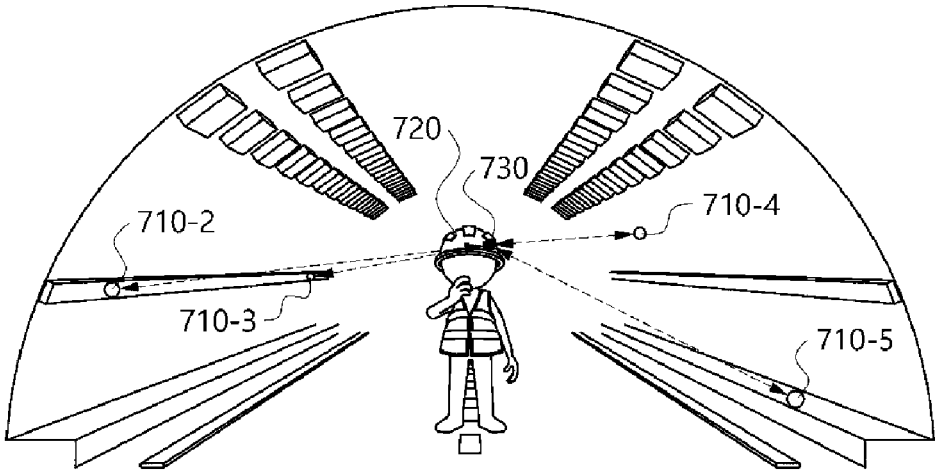
FIG. 7B is another diagram showing a method for identifying a worker in a tunnel according to an embodiment of the present disclosure.

Subsequently, referring to FIG. 7B, a plurality of helmet built-in devices 710-2, 710-3, 710-4, 710-5 may be provided to identify location information and condition information of the worker in the tunnel. In this instance, the helmet built-in devices 710-2, 710-3, 710-4, 710-5 may be attached to various locations in the tunnel. Additionally, in an example, the helmet built-in devices 710-2, 710-3, 710-4, 710-5 may not be easy to replace and install, and thus may be implemented as low-energy devices, and is not limited to the above-described embodiment. In this instance, in an example, the above-described tunnel accident prevention server or other system may pre-acquire the location information of the helmet built-in devices 710-2, 710-3, 710-4, 710-5. That is, the system may identify the locations at which the helmet built-in devices 710-2, 710-3, 710-4, 710-5 are attached in the tunnel. In this instance, in an example, the identification device 730 of the safety helmet 720 worn on the worker may communicate with at least one helmet built-in device 710-2, 710-3, 710-4, 710-5. In an example, when the worker is located within a preset distance from a specific helmet built-in device, the helmet built-in device may communicate with the identification device 730 of the worker. Subsequently, the helmet built-in device may transmit the location information of the worker to the server based on the recognized identification device 730.

In another example, a plurality of helmet built-in devices may be used. In an example, the helmet built-in devices may be attached at a predetermined interval in the tunnel, and the number of helmet built-in devices may be limited. Accordingly, only one helmet built-in device may have a limitation in identifying the location of the worker. In this instance, the plurality of helmet built-in devices may communicate with the identification device 730 of the worker, and information acquired via the wireless communication may be transmitted to the server. In this instance, the server may calculate the location of the worker using the acquired information and the location information of the helmet built-in device. In an example, time information at which the helmet built-in device exchanges a signal with the identification device 730 of the worker may be transmitted to the server. The server may acquire the time information from the plurality of helmet built-in devices, and identify the location information of the worker by calculating the time information, but is not limited to the above-described embodiment.

In this instance, in an example, the server may be the above-described tunnel accident prevention server. In a more specific example, the tunnel accident prevention server may predict an accident in the tunnel through water level measurement as described above. In an example, the tunnel accident prevention server may determine an emergency situation when the water level is higher than the above-described threshold value, and transmit accident prediction information to the worker. Additionally, the tunnel accident prevention server may set a plurality of reference information and determine each situation based on the reference information, and the method for determining an emergency situation is not limited to the above-described embodiment. In this instance, in an example, when the tunnel accident prevention server determines an emergency situation, the tunnel accident prevention server may transmit a warning message based on the location information of the worker. In an example, the tunnel accident prevention server may acquire the location information of the worker as described above through the plurality of helmet built-in devices. Subsequently, the server may transmit the warning message to the identification device 730 of the worker through the plurality of helmet built-in devices. In this instance, the identification device 730 may receive the warning message and output warning sound. Additionally, in an example, the identification device 730 may transmit the warning message to the worker by vibration, voice or other methods, and is not limited to the above-described embodiment.

In still another example, when an emergency situation is determined, the tunnel accident prevention server may control a device for opening and closing the entrance/exit of the tunnel. Additionally, in an example, the tunnel accident prevention server may control a device for opening and closing at least one door in the tunnel. In this instance, in an example, the tunnel accident prevention server may control a device for opening and closing the entrance/exit of the tunnel and a device for opening and closing a plurality of doors installed in the tunnel. In more detail, when an emergency situation is determined, it is necessary to prevent more workers from entering the tunnel. Additionally, as described above, when the tunnel accident prevention server identifies the location of the worker in the tunnel, the tunnel accident prevention server may control the opening/closing of at least one of the plurality of doors installed in the tunnel to ensure the safety of the worker and determine the water movement direction. That is, the tunnel accident prevention server may control the door to prevent more workers from entering the tunnel in order to prevent an accident. Additionally, in an example, the tunnel accident prevention server may control whether to open or close the door disposed at other location in the tunnel to control the amount of water at the location of the worker, taking the location of the worker into account.

In yet another example, the above-described emergency situation may be determined for each location in the tunnel. In an example, at least one of the width and height of the tunnel, the reference water level or floating matter may be different for each location of the tunnel in the tunnel. In view of the foregoing, an emergency situation may be determined at each location in the tunnel. In an example, the above-described threshold water level of FIG. 5 may be differently set for each location in the tunnel based on the inside characteristics of the tunnel. In an example, the tunnel accident prevention server may determine whether it is an emergency situation, taking into account the characteristics of the tunnel at each location by dividing the inside of the tunnel into a predetermined interval and differently setting the threshold water level for each predetermined interval.

In further another example, when the tunnel accident prevention server determines an emergency situation, the tunnel accident prevention server may control whether to open and close the door to safely evacuate the worker from the tunnel, taking into account each location in the tunnel. In an example, as described above, the width and height of the tunnel, the reference water level and floating matter may be different for each location in the tunnel. In this instance, in an example, the tunnel accident prevention server may close the door at a region in which the water level is higher than the threshold water level or a danger is predicted, and induce the worker to escape along a safe route in order to safely evacuate the worker from his or her location.

That is, the tunnel accident prevention server may acquire the location of the worker through the identification device 730 and the plurality of helmet built-in devices, determine an emergency situation and transmit a warning message to the worker. Additionally, the tunnel accident prevention server may prevent an additional accident by controlling whether to open and close the entrance/exit of the tunnel and the door in the tunnel.

Figure 8:
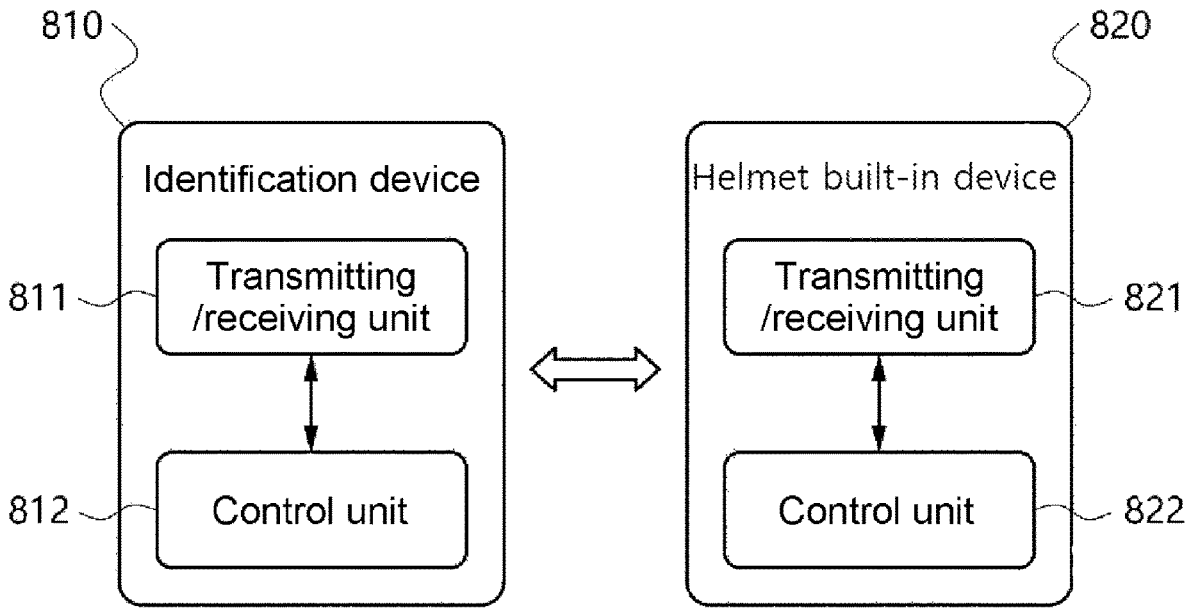
FIG. 8 is a diagram showing a method for wireless communication between an identification device and an safety helmet built-in device according to an embodiment of the present disclosure.

FIG. 8 is a diagram showing a method for wireless communication between the identification device and the helmet built-in device according to an embodiment of the present disclosure.

As described above, the identification device may communicate with the helmet built-in device. In this instance, for example, referring to FIG. 8, the identification device 810 may include a transmitting/receiving unit 811 and a control unit 812. In an example, the transmitting/receiving unit 811 of the identification device 810 may exchange a signal with the helmet built-in device 820. Additionally, in an example, the transmitting/receiving unit 811 of the identification device 810 may exchange data with the helmet built-in device 820. Additionally, in an example, the control unit 812 of the identification device 810 may control the transmitting/receiving unit 811. In this instance, the identification device 810 may further other components, and the components included in the identification device 810 may be controlled by the control unit 812, and are not limited to the above-described embodiment.

Additionally, in an example, the helmet built-in device 820 may include a transmitting/receiving unit 821 and a control unit 822. In an example, the transmitting/receiving unit 811 of the helmet built-in device 820 may exchange a signal with the identification device 810. Additionally, in an example, the transmitting/receiving unit 821 of the helmet built-in device 820 may exchange data with the identification device 810. Additionally, in an example, the control unit 822 of the helmet built-in device 820 may control the transmitting/receiving unit 821. In this instance, the helmet built-in device 820 may further include other components, and the components included in the helmet built-in device 820 may be controlled by the control unit 822, and are not limited to the above-described embodiment.

That is, as described above, the location of the worker may be identified and the warning message may be transmitted based on the above-described device.

Figure 9:
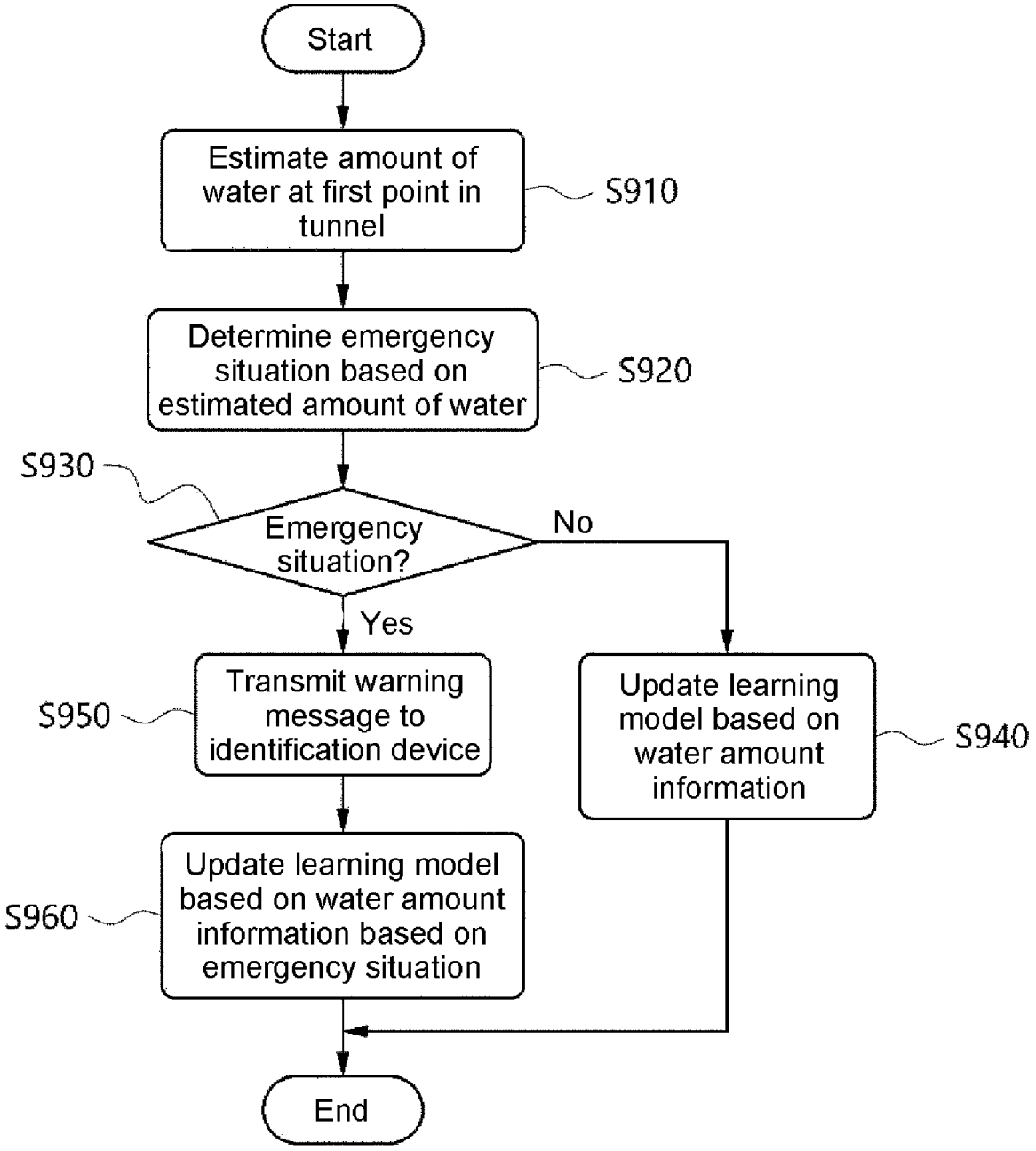
FIG. 9 is a flowchart showing a method for preventing an accident in a tunnel according to an embodiment of the present disclosure.

FIG. 9 is a flowchart showing a method for preventing an accident in a tunnel according to an embodiment of the present disclosure.

Referring to FIG. 9, a server may estimate the amount of water at a first point in the tunnel (S910). In an example, the server may estimate the amount of water at the first point that is a specific point in the tunnel. In more detail, as described above, the tunnel runs long, and an emergency situation may be differently determined for each location. In an example, as described above, the server may determine an emergency situation by comparing the amount of water at the specific point with a threshold value. Additionally, in an example, as described above, the server may calculate the time at which the amount of water at the corresponding point reaches the threshold value based on a learning model learned based on input information. That is, the server may calculate the time at which the amount of water at the corresponding point reaches the threshold value based on the learning model and the input information, and estimate the amount of water at the corresponding point through the foregoing. In an example, the input information may include at least one of rainfall amount information, location information in the tunnel, water movement duration information, surrounding environmental information, nearby river water amount information or floodgate opening/closing information, and is not limited to the above-described embodiment.

Subsequently, the server may determine an emergency situation based on the estimated amount of water (S920). In an example, the server may determine if an emergency situation will occur in which the amount of water is higher than the threshold value based on the amount of water estimated as described above (S930). In this instance, when an emergency situation does not occur, the server may continuously update the above-described learning model based on the water amount information, and the learning model may increase the estimation accuracy based on the updated information (S940). Meanwhile, in an example, when the server determines an emergency situation based on the water amount information estimated as described above, the server may transmit a warning message to the identification device (S950). In this instance, the identification device may be a device attached to a worker's safety helmet. Additionally, in an example, the identification device may be attached to the worker's other device, and is not limited to the above-described embodiment. Additionally, in an example, the server may transmit the warning message to the identification device through the device attached into the tunnel. In this instance, the identification device may notify an emergency situation to the worker through warning sound or vibration based on the warning message.

Additionally, in an example, the server may update the learning model based on the water amount information based on the above-described emergency situation (S960). That is, it is possible to increase the accuracy of the estimation system for preventing an accident that may occur later by reflecting the information about the emergency situation on the learning model.

Figure 10:
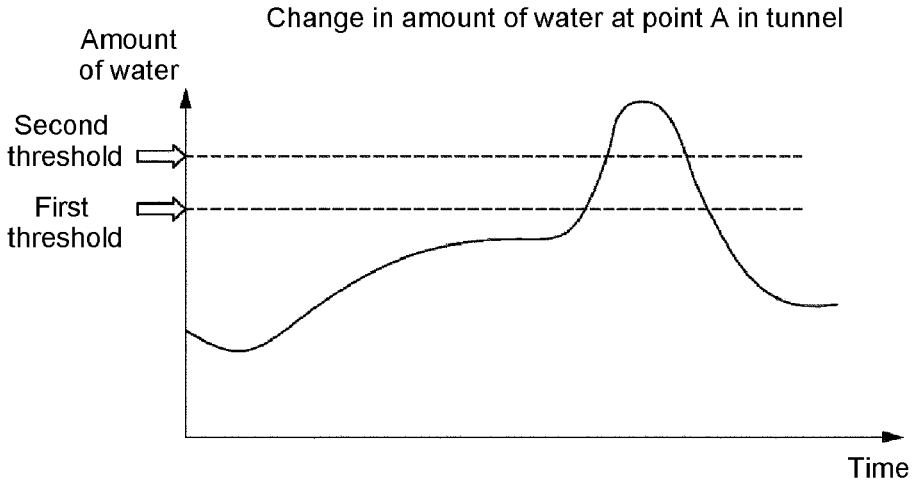
FIG. 10 is a diagram showing a method for determining an emergency situation based on the amount of water according to an embodiment of the present disclosure.
Figure 11:
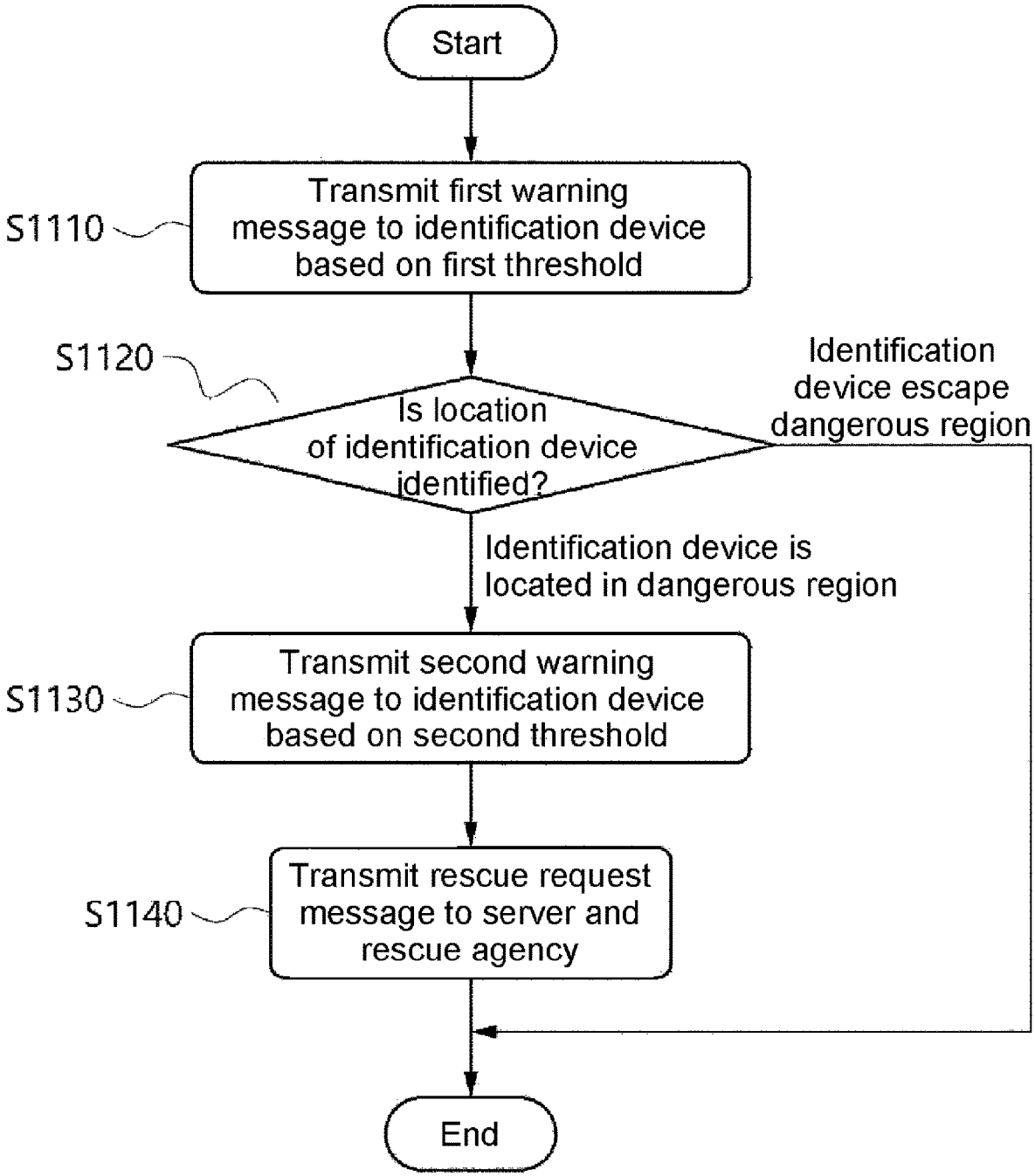
FIG. 11 is a flowchart showing a method for preventing an accident in a tunnel according to an embodiment of the present disclosure.

FIGS. 10 and 11 are flowcharts showing a method for preventing an accident in a tunnel according to an embodiment of the present disclosure.

In an example, referring to FIG. 10, the threshold value for determining an emergency situation based on the water amount information may be set as a first threshold value and a second threshold value. In more detail, in case that an emergency situation is determined based on the water amount information, when the threshold value is high, emergency situation estimation may be delayed, and an accident may occur before the worker escapes the dangerous situation. In view of the foregoing, a plurality of threshold values may be set. In an example, although FIGS. 10 and 11 describe two set threshold values, more than two threshold values may be set. However, for convenience of description, the following description is made based on two threshold values.

In this instance, in an example, the server may compare the water amount information at a specific point in the tunnel with the first threshold value. In this instance, in an example, the first threshold value may be smaller than the second threshold value. In this instance, the server may transmit a first warning message to the identification device based on the first threshold value (S1110). That is, as described above, to prevent the delayed emergency situation estimation, when it is estimated that a predetermined amount of water will be reached, the server may transmit the first warning message to the worker. In this instance, the worker may escape a dangerous region based on the warning message. In this instance, in an example, the server may identify the location of the identification device (S1120). That is, the server may identify whether the worker escaped the dangerous region by identifying the location of the identification device after transmitting the first warning message. In this instance, when the worker escapes the dangerous region, further measures may not be needed. However, in an example, there may be the case that the worker does not escape the dangerous region. That is, the location of the identification device may be still in the dangerous region. In this instance, when the amount of water reaches the second threshold value or is predicted to reach based on the water amount information, the server may transmit a second warning message to the identification device (S1130). That is, the server may transmit the two warning messages to the identification device. In this instance, in another example, despite the two warning messages as described above, when the worker fails to escape the dangerous region, the server may determine a high likelihood that an accident will occur, and transmit a rescue request message to the server and a rescue agency based on the identification device (S1140). That is, each situation may be differently determined based on the plurality of threshold values, and an accident may be prevented through measures based on the situation determination.

The above-described embodiments of the present disclosure may be implemented through a variety of means. For example, the embodiments of the present disclosure may be implemented by hardware, firmware, software or a combination thereof.

In the case of implementation by hardware, the method according to the embodiments of the present disclosure may be implemented by one or more Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controls, microcontrollers and microprocessors.

In the case of implementation by firmware or software, the method according to the embodiments of the present disclosure may be implemented in the form of modules, procedures or functions that perform the above-described functions or operations. The software code may be stored in a memory unit and executed by a processor. The memory unit may be disposed inside or outside the processor to transmit and receive data to/from the processor by a variety of known means.

The detailed description of the preferred embodiment of the present disclosure as described above is provided to allow those skilled in the art to embody and practice the present disclosure. While the present disclosure has been hereinabove described with reference to the preferred embodiment of the present disclosure, those skilled in the art will understand that various modifications and changes may be made thereto without departing from the spirit and scope of the present disclosure defined in the appended claims. Accordingly, the present disclosure is not limited to the disclosed embodiments, and is intended to provide the broadest scope corresponding to the disclosed principles and new features. Additionally, while the preferred embodiment of the present disclosure has been hereinabove shown and described, the present disclosure is not limited to the above-described specific embodiment, and it is obvious that many different variations may be made thereto by those having ordinary skill in the technical field pertaining to the present disclosure without departing from the subject matter of the present disclosure set forth in the appended claims, and such variations should not be individually understood from the technical spirit and scope of the present disclosure.

Additionally, the present disclosure describes both the product invention and the method invention, and the description of the two inventions may be complementarily applied where necessary.

The invention claimed is:

1. A control method for preventing an accident in a tunnel, comprising:

estimating water amount information flowing into the tunnel based on at least one input information;

determining whether an emergency situation based on the estimated water amount information; and transmitting a warning message to an identification device when there is an emergency situation, and controlling a device for opening and closing an entrance/exit of the tunnel, estimating the water amount information flowing into the tunnel through a deep learning based learning model, determining the emergency situation by comparing water level information of the tunnel with a threshold value, determining the emergency situation further comprises dividing an inside of the tunnel into a predetermined interval, and taking into account a width and a height of the tunnel, a reference water level and floating matter for each predetermined interval, the identification device is a device mounted on a safety helmet of a worker in the tunnel, and location information of the identification device is identified based on at least one helmet built-in device installed in the tunnel, and controlling the device for opening and closing the entrance/exit of the tunnel comprises opening or closing a door at a region in which a water level is high or a danger is predicted to control the amount of water level at a location of the worker in the tunnel and at a location of an escape route taking into account the location of the worker in the tunnel in case of the emergency situation.

2. The control method for preventing an accident in a tunnel according to claim 1, wherein the input information includes at least one of rainfall amount information, location information in the tunnel, water movement duration information, surrounding environmental information, nearby river water amount information, or water gate opening/closing information.

3. The control method for preventing an accident in a tunnel according to claim 2, further comprising measuring the water amount information at a first location in the tunnel at a first point in time based on at least one of the input information, and basing the deep learning based learning model on the measured water amount information and the at least one input information.

4. The control method for preventing an accident in a tunnel according to claim 1, wherein when the emergency situation is determined, transmitting the warning message from the helmet built-in device based on the identified location information of the identification device.

5. The control method for preventing an accident in a tunnel according to claim 1, further comprising, after determining the emergency situation:

controlling the device for opening and closing the at least one door based on the emergency situation, and when the emergency situation is determined, the entrance/exit of the tunnel is controlled to be closed, and determining opening or closing of the at least one door based on the location of the identification device.

6. A server for preventing an accident in a tunnel, comprising:

a location identifying unit to identify each geographical location in the tunnel;

a water amount measuring unit to measure an amount of water in the tunnel based on the identified location;

a deep learning unit to perform water amount estimation based on the measured water amount information;

a transmitting/receiving unit to communicate with an external device; and a control unit to control the location identifying unit, the water amount measuring unit, the deep learning unit, and the transmitting/receiving unit, wherein the control unit is configured to: estimate, using a deep learning based learning model, water amount information flowing into the tunnel based on at least one input information, determine whether there is an emergency situation based on the estimated water amount information, transmit a warning message to an identification device, and control a device for opening and closing an entrance/exit of the tunnel when the emergency situation is determined, and wherein the water amount information flowing into the tunnel is estimated through a deep learning based learning model, and the emergency situation is determined by comparing water level information of the tunnel with a threshold value, the control unit divides an inside of the tunnel into a predetermined interval, and determines the emergency situation taking into account a width and a height of the tunnel, a reference water level and floating matter for each predetermined interval, the identification device is a device mounted on a safety helmet of a worker in the tunnel, and location information of the identification device is identified based on at least one helmet built-in device installed in the tunnel, and in case of the emergency situation, the control unit closes a door at a region in which the water level is high or a danger is predicted to control the amount of water at a location of the worker and an escape route taking into account the location of the worker in the tunnel.

* * * * *